United States Patent [19]

Daum et al.

[11] 4,065,214

[45] Dec. 27, 1977

[54] PORTABLE WAX APPLICATOR AND REMOVER

[76] Inventors: Emill F. Daum, 2911 Via San Gorgonio, San Clemente, Calif. 92672; Terry R. Daum, 34581 Via Verde, Capastrano Beach, Calif. 92624; Dennis Daum, 2911 Via San Gorgonio, San Clemente, Calif. 92672

[21] Appl. No.: 718,460

[22] Filed: Aug. 30, 1976

[51] Int. Cl.[2] ..... A46B 11/08; A47L 13/32; B43M 1/02

[52] U.S. Cl. ..... 401/2; 219/228; 15/250.06

[58] Field of Search ..... 401/2, 1; 219/228, 227; 15/236 R, 250.09, 250.06, 250.05

[56] References Cited

U.S. PATENT DOCUMENTS

| | | | |
|---|---|---|---|
| 2,118,415 | 5/1938 | Pesark | 401/1 |
| 2,265,551 | 12/1941 | Steccone | 15/236 R |
| 3,228,566 | 1/1966 | Knox, Jr. | 401/1 |
| 3,489,884 | 1/1970 | Waseleski, Jr. | 15/250.05 X |
| 3,935,425 | 1/1976 | Weissberger et al. | 219/228 |
| 3,950,105 | 4/1976 | Moss et al. | 401/1 |
| 3,968,345 | 7/1976 | Kollmeder | 401/1 X |
| 3,969,025 | 7/1976 | Brodie | 401/2 |

FOREIGN PATENT DOCUMENTS

| | | | |
|---|---|---|---|
| 960,164 | 2/1957 | Germany | 401/1 |

*Primary Examiner*—Stephen C. Pellegrino
*Attorney, Agent, or Firm*—Frank D. Gilliam

[57] ABSTRACT

An apparatus for applying and removing wax from the running surface of a snow ski. The apparatus comprises a central housing, the upper portion of which comprises an open container for holding the wax. A removable lid with a resilient "O" ring seal selectively covers and seals the opening in the container. A handle with an easy grip heat insulated end surface extending from the side of the central housing provides ease of handling the heated device. A wax spreader containing an electric heating element and a thermostat extends downward from the central housing. A selectively operable valve is provided for selectively releasing hot liquid wax from the container to the running surface of the ski. The spreader is bowed to provide ease of operation on a convex surface.

7 Claims, 5 Drawing Figures

PORTABLE WAX APPLICATOR AND REMOVER

BACKGROUND OF THE INVENTION

The invention relates generally to hot liquid wax applicators and more specifically to a portable hot liquid wax applicator and wax remover for use with the running surface of a conventional snow ski.

It has long been common practice for skiers to apply some form of wax to the running surfaces of their skis, as dictated by the snow conditions and perfection with which the skier approaches the sport.

Through the years, hot wax has been applied and old wax has been removed from skis by various methods. Wax can be melted in a container over a fire then poured on the running surface of the ski and then smoothed with a hot, flat surface, such as, a common flat iron. This method is crude, consumes considerable time, wastes wax, generally creates a mess and the finished surfaces are not always acceptable to a sophisticated skier. Larger, modern ski resorts and the like have containers of hot melted wax large enough to dip the entire running surface of the ski in for coating or recently have installed large stationary ski waxing machines. These units are, of course, too large and expensive for the weekend skier. They are not always available because of the number of skiers having limited time requiring the service and the cost of the service may be prohibitive.

There has been several attempts to provide a portable, inexpensive liquid wax applicator satisfactory for the waxing of skis. Examples of two of these devices are taught by U.S. Pat. Nos. 3,950,105 and 3,968,345.

U.S. Pat. No. 3,950,105 teaches an open laddle like container with a partially open upper surface. The upper portion of the forward wall of the container has a plurality of small bore apertures therethrough leading to an exernal slot. The bottom of the laddle like container resembles a common flat iron. A heater is provided to heat the entire device and melt wax placed in the container. The device has no means for maintaining or controlling the heat of the heater. Over heating of the device after prolonged use could result in damaging the running surface of the ski or boiling over causing injury to the user. Application of hot wax to the ski requires a two step operation; first, the device is placed on the ski surface handle up, so that hot wax can flow from the container to the ski. The device is then pulled along the ski leaving an uneven layer of wax. The device is then placed with the handle substantially parallel with the running surface and the bottom flat iron like portion is ironed across the ski surface smoothing the uneven coating of wax. The container has no provisions for a cover or lid for the open portion of the container. Any contaminate falling into the hot melted wax would either be applied to the ski surface or plug up the apertures restricting the flow of wax and the device must remain in its ironing position until the wax again solidifies.

U.S. Pat. No. 3,968,345 teaches a device that combines a wax applicator and an edge sharpening device. The wax portion generally resembles the aforementioned patented device in that it has an open hot wax container, a plurality of apertures for the liquid wax to flow through and a flat iron like bottom surface. This device, like the aforementioned device has similar drawbacks and limitations.

SUMMARY OF THE INVENTION

The portable wax applicator of the instant invention is characterized by an enclosed liquid wax container, a combination wax spreader and remover blade, a thermostat controlled heating element within the spreader, remover blade, a handle member with an adjacent control valve selectively operable for controlling the flow of hot liquid wax from the container to the ski surface.

The apparatus of the instant invention provides a convenient means for applying and spreading new wax and removing old wax from the running surface of a snow ski.

The waxing and smoothing is performed in one continuous operation, the temperature is controlled by the thermostat, the flow of liquid wax to the ski is controlled by the control valve. A removable lid or closure for the container opening is provided to prevent contamination of the wax and to provide for safety and ease of storage.

The device is simple to operate, inexpensive to construct and provides the perfection required by skiers.

The foregoing and various other features of the invention will appear in the course of the description which is rendered below with reference to the accompanying drawings, wherein the same reference numerals depict the identical element or part.

DESCRIPTION OF THE PREFERRED EMBODIMENTS

Figure 1:
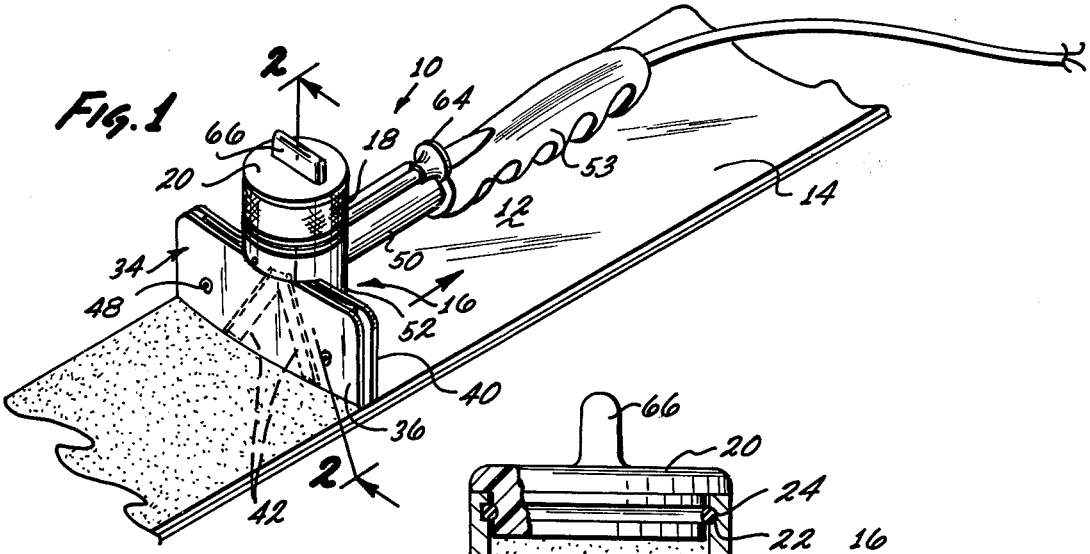
FIG. 1 is a perspective view of the combination portable wax applicator and remover in an operable position for waxing a ski.
Figure 2:
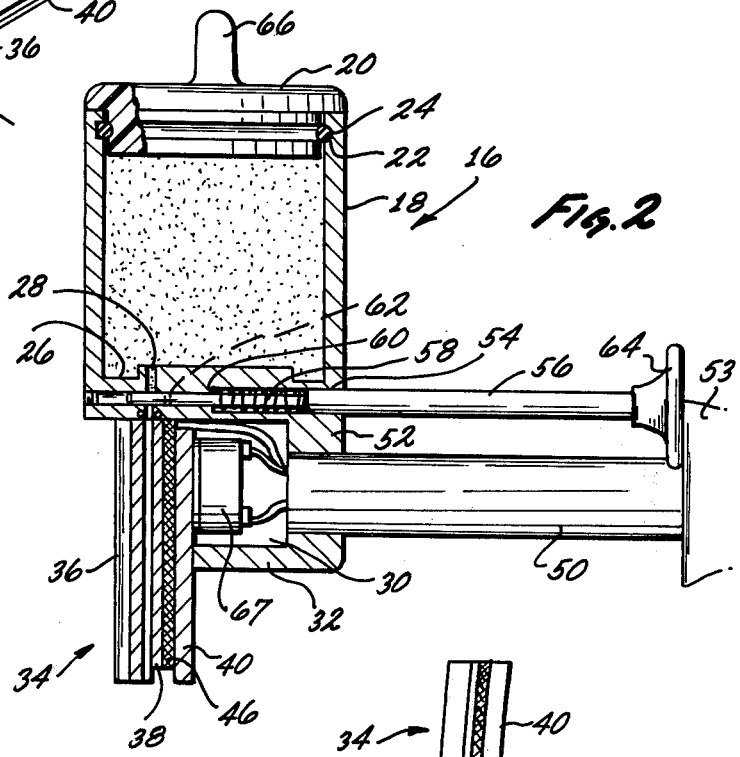
FIG. 2 is a side cut away view taken along lines 2—2 of FIG. 1.

Referring now to the various Figures of the drawings, the wax applicator 10 of the instant invention is shown in FIG. 1 resting upon the running surface 12 of a snow ski 14. The wax applicator 10 has a central body portion 16. The central body portion is shown having the general cross-sectional form of a cylinder. The particular shape of the device should not be considered as limiting the invention as any shape that can provide the functional concepts as hereinafter described may be utilized with equal success in practicing the invention. The central body portion 16 may be constructed of any heat conductive material such as metal or the like. The upper part of the central body portion provides an open container 18 for containing wax to be melted therein. The open upper portion of the container 18 is fitted with a removable lid 20 constructed of any suitable material that may be the same as or unlike the material of the central body portion 16. Along the upper inner surface of the container 18 a semi-circular groove 22 is provided for receiving and containing the "O" ring type seal 24. The "O" ring provides a means for sealing and holding lid 24 in place in the container opening. The lid may have like grooves rather than the container or they both may have similar grooves. The manner by which the lid 20 secures and seals may take many forms other than the form shown, such as, but not limited to male and female threads for threading the lid to the container. The bottom wall 26 has an aperture 28 extending therethrough. Referring now specifically to FIG. 2, the upper end of aperture 28 is positioned above the lowest level of the bottom wall 26 so as to prevent any foreign objects from closing off the flow through the aperture.

Part of the lower portion of central body portion 16 is cutaway providing a recessed area 30. The ends of the bottom wall 32 and the bottom wall 26 of the container 18 provide attachment structure for the downwardly extending wax spreader element 34. The wax spreader element 34 comprises a removable front plate 36, a fixed, intermediate plate 38 and a fixed rear plate 40 secured to the end of walls 26, 32. The removable front plate 36 has a pair of channels 42 having a common upper portion 44 and extending downward in the form of an inverted "V" to the lower edge of the blade 36 (see FIG. 5). The upper portion 44 of the channels align with the lower opening of aperture 28. The intermediate plate 38 forms the other wall of the channels 42 and isolates the hot wax from the heater element 46 hereinafter discussed. Sandwiched between the intermediate plate 38 and the fixedly positioned plate 40 is a flat heating element 46 substantially the same dimensions as the various plates to ensure uniform heating of the wax spreader element 34.

The various plates and the heating element comprising the wax spreader element 34 are either fixedly secured together by securing means such as rivots or the like, not shown, or removably attached to the fixed plate 40 (by screw and threaded aperture fastening means 48.).

A handle member 50 is fitted within and secured to wall 52 of the central body portion 16 by any conventional attachment means, such as, brazing threaded or the like. The outer periphery of the outer end of the handle member 50 includes an insulated grip member 53 for isolating the heat of the apparatus from the user. The grip member 53 is designed to fit the hand of the operator for ease of manipulation.

Figure 4:
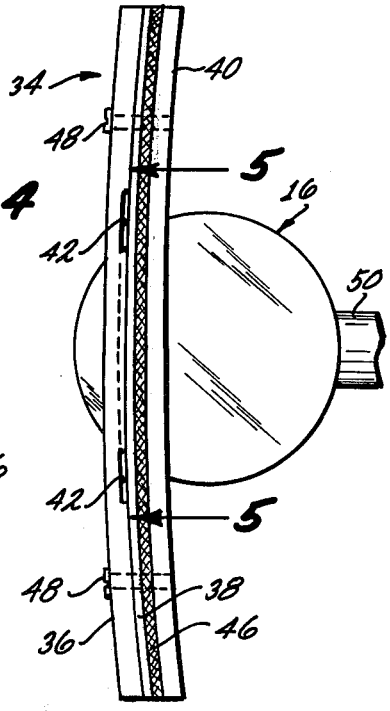
FIG. 4 is a showing of the bottom view of the scraper of the device.
Figure 3:
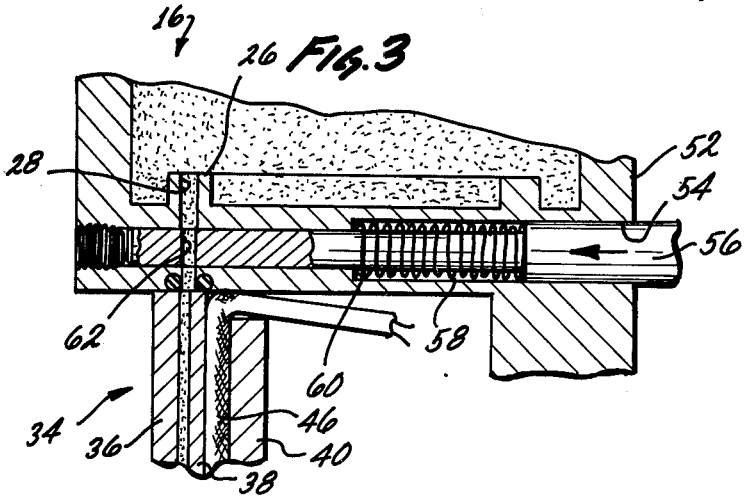
FIG. 3 is an enlarged showing of the valve mechanism of FIG. 2.

A passage way or bore 54 is provided within the bottom wall 26 of the container 18 for receiving a slidable valve member 56. The passage way 54 has a smaller cross-section forward of the center of the container 18 than rearward. The valve member 56 has a smaller cross-section at its forward end than the end extending from wall 52. A coil spring is trapped between the valve member 56 at one end and confined by shoulder 60. An aperture 62 extends through one end of the valve member 56. When coil spring 58 is compressed (as shown in FIG. 3) apertures 28 and the channel upper opening 44 are co-axial. When the coil spring 58 is relaxed (shown in FIG. 4) aperture 62 is out of alignment with aperture 28 and channel opening 44. The length of the valve member 56 is chosen so that when button 64 at its outer end is fully depressed, the aperture and upper open portion of the channels are in alignment and when released, the spring confines the member against the grip member 53. With the grip member removed, the valve member can be removed from the device for cleaning, etc.

Within the recess 30, is positioned the thermostat 67 attached to the rear surface of fixed plate 40. The thermostat is series wired with the heating element to control the heat of the plate 40 in a conventional manner. The fixed plate includes a cutaway portion for allowing the wire from the heating element to be exposed within the recessed area 30. The handle member is hollow so that the wiring for the heater and thermostat extend through the handle to a convenient power outlet for operating the device (see FIG. 1).

Figure 5:
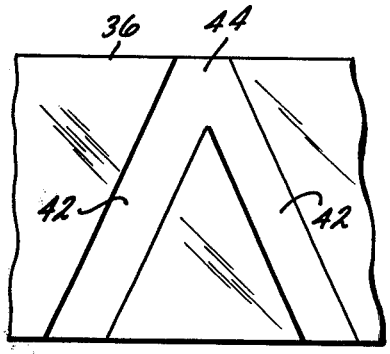
FIG. 5 is a cut away showing taking along lines 5—5 of FIG. 4, showing the wax flow channels.

Referring now to FIG. 5, the wax spreader element 34 is bowed toward the handle to provide a satisfactory means for spreading and removing from a concave or convex surface.

OPERATION OF THE DEVICE

The container of the device is filled with particles or chunks of solid wax by removing the lid 20 by pulling upward on the extending center portion 66. The lid is then replaced over the upper opening of the container. The power cord 68 is then connected to a convenient power source (not shown) generally a readily available 115V AC wall outlet. Various types of heating elements may be employed to adapt to various other electrical sources, such as those used in European countries.

With the power source connected to the heater element and series thermostat, the entire device is elevated in temperature through conduction from the heating element until the wax in the container is melted and the thermostat cycles the device at a selected temperature. The device is now ready for use.

If first cleaning the running surface of old wax is desired, the now heated device with the wax spreader element in contact with the ski and the handle substantially parallel therewith, the device is either pulled or pushed along the surface and the wax scraped off. After the old wax is melted and removed, new wax may now be applied. Obviously, on some occasions, it may be desirable to reuse the old wax coating by merely smoothing it out and adding additional new wax if desired.

When a new coating or additional depth of wax is required, the device is positioned on the running surface in a same or similar manner as discussed. The operator then selectively presses button 64 moving slide valve member 56 against coil spring 58 aligning the aperture in the valve member with the container aperture and the common upper portion of the channels in the removable front plate allowing the now liquid wax to flow to the outer edge of spreader element 34. The thickness of the new wax coating will be determined by the speed at which the operator moves the device across the running surface of the ski.

When the cleaning and/or waxing is completed, the bottom is released, returning the valve to its normally closed position and the device is then disconnected from the power source and stored for future use.

The term wax used throughout the application is intended to include any natural and man-made substances suitable for the purpose claimed.

Many changes may be made in details of the instant invention, in the method and materials of fabrication, in the configuration and assemblage of the constituent elements, without departing from the spirit and scope of the appended claims, which changes are intended to be embraced therewithin.

Having thus described the invention, what is claimed as new and useful and desired to be secured by United States Letters Patent is:

1. A portable wax applicator comprising:

a housing member having an open upper surface for containing wax to be applied, said housing member having an aperture through the bottom wall thereof;

a handle attached to and extending from said housing member;

a spreader member positioned transverse to said handle and attached to said bottom wall and extending downward therefrom; and a heater means;

said spreader member comprising a pair of flat plate members secured together with said heater means sandwiched therebetween, one of said plate members having wax distributing channels in alignment with and extending from said aperture in said bottom wall to the lower periphery of said spreader, said heater element having substantially the same surface area as said plate members.

2. The invention as defined in claim 1, wherein a valve member is positioned between said aperture in said bottom wall and said channels for selectively controlling the flow of wax from said housing to the periphery of said spreader.

3. The invention as defined in claim 1, wherein said spreader and said heater means are bowed toward said handle.

4. The invention as defined in claim 1, wherein said heater means is an electric heater operable from house current and has in series therewith a thermostat for regulating the heat of said electric heater.

5. The invention as defined in claim 1, wherein the open upper surface of said housing member is closed and sealed with a removable closure member.

6. A portable wax applicator comprising:

an open housing member for containing wax to be melted and applied to an object, said housing member has a removable lid for closing and sealing the opening therein and an aperture through its bottom wall for the flowing of melted wax therefrom;

a heat insulated handle attached to and extending from said housing member;

a spreader member positioned transverse to said handle, attached to the bottom wall of said open housing and extending downward therefrom, a valve means;

an electric heater; and a thermostat for regulating the temperature of said wax applicator;

said spreader member comprising a pair of flat plate members secured together with said heater means sandwiched therebetween, one of said plate members has wax distributing channels in alignment with and extending from said aperture in said bottom wall to the lower periphery of said spreader members, said heater element having substantially the same surface area as said plate members.

7. The invention as defined in claim 6, wherein said wax distributing channels angle outward from said aperture toward said lower periphery of said spreader member.

* * * * *